US007011034B2

(12) United States Patent
Cho

(10) Patent No.: US 7,011,034 B2
(45) Date of Patent: Mar. 14, 2006

(54) EMBROIDERED PATCH AND MANUFACTURING METHOD THEREOF

(75) Inventor: Byoung-Woo Cho, Yongin (KR)

(73) Assignee: Yupoong, Inc., Seoul (KR)

( * ) Notice: Subject to any disclaimer, the term of this patent is extended or adjusted under 35 U.S.C. 154(b) by 0 days.

(21) Appl. No.: 10/893,327

(22) Filed: Jul. 19, 2004

(65) Prior Publication Data

US 2005/0087114 A1 Apr. 28, 2005

(30) Foreign Application Priority Data

Oct. 22, 2003 (KR) ..... 10-2003-0073684

(51) Int. Cl.
*D05C 17/00* (2006.01)

(52) U.S. Cl. ..... 112/475.22; 112/439

(58) Field of Classification Search ..... 112/475.22, 112/439, 98, 99, 429, 441, 475.18; 156/93; 2/244

See application file for complete search history.

(56) References Cited

U.S. PATENT DOCUMENTS

| | | | | |
|---|---|---|---|---|
| 889,614 | A * | 6/1908 | Johnsen | 112/475.18 |
| 5,241,919 | A * | 9/1993 | LaGreca | 112/410 |
| 5,399,410 | A * | 3/1995 | Urase et al. | 428/102 |
| 5,832,854 | A * | 11/1998 | Lin et al. | 112/475.22 |
| 5,947,044 | A * | 9/1999 | Lin et al. | 112/475.22 |
| 6,164,228 | A * | 12/2000 | Lin et al. | 112/475.22 |

FOREIGN PATENT DOCUMENTS

| | | |
|---|---|---|
| JP | 5-195411 | 8/1993 |
| KR | 2000-14014 | 3/2000 |

* cited by examiner

*Primary Examiner*—Ismael Izaguirre
(74) *Attorney, Agent, or Firm*—Staas & Halsey LLP

(57) ABSTRACT

An embroidered patch and manufacturing method thereof is disclosed. The method is performed by providing a filler, embroidering the desired embroidering figure on the filler to entirely wrap up an embroidering portion of the filler. During embroidering, a periphery of the embroidering portion being perforated by the needles of the embroidering machine and a plurality of sewing threads. The embroidering portion is then pulled to remove a leftover portion, resulting in the embroidered patch without any cutter.

11 Claims, 3 Drawing Sheets

EMBROIDERED PATCH AND MANUFACTURING METHOD THEREOF

BACKGROUND OF THE INVENTION (a) Field of the Invention

The present invention relates to an embroidered patch and manufacturing method thereof, and more particularly to a method of manufacturing a protruding embroidered patch which is adapted for being attached to caps or clothes.

(b) Description of the Related Art

A conventional method of manufacturing an embroidered patch is as follows. First, embroidery is performed directly on nylon or mesh, or on other intervening fabrics. Next, the outline of the embroidery is cut by a cutter which uses heat or blades. Then, yarn remaining after the cutting is removed by cutting again with scissors or by heat treatment, to obtain an embroidered patch.

The conventional method of manufacturing an embroidered patch has several drawbacks, in that the cutting processes are liable to be erroneously performed, and the cutting processes are added to the embroidery process to increase the number of steps, resulting in low productivity.

SUMMARY OF THE INVENTION

In view of the prior art described above, it is an object of the present invention to provide an embroidered patch which is capable of being manufactured in a relatively simple manufacturing process.

It is another object of the present invention to provide a manufacturing method of an embroidered patch having no cutting process in which a separate cutter is used.

To achieve these and other objects, as embodied and broadly described herein, a manufacturing method of an embroidered patch includes:

providing a filler which has a predetermined thickness and a size larger than a desired embroidering figure;

embroidering the desired embroidering figure on the filler to entirely wrap an embroidering portion of the filler, a periphery of the embroidering portion of the filler being perforated by a plurality of sewing threads; and removing a leftover portion, which is an outer portion of the filler surrounding the embroidering portion.

A base member and an upper member can be provided at either side of the filler before the embroidering. The base member or the upper member is selected from a non-woven fabric, paper, and a plastic sheet.

According to another aspect of the present invention, an embroidered patch includes a filler having a predetermined thickness, and a plurality of sewing threads enwrapping an embroidering portion in which a desired embroidering figure is formed. The periphery of the embroidering portion is perforated by a plurality of sewing threads. A leftover portion which is an outer portion of the filler surrounding the embroidering portion is removed by cutting away the periphery of the embroidering portion of the filler.

The embroidered patch preferably has either or both of a base member placed under the filler, and an upper member placed on the filler. The base member or upper member is embroidered. The outer portions of the base member and the upper member surrounding the embroidering portion are removed together with the filler.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

Figure 1:
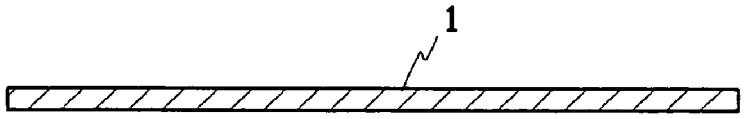
FIGS. 1 to 5 are sectional views which sequentially illustrate a manufacturing method of an embroidered patch according to the present invention.

Preferred embodiments of the present invention will hereinafter be described in detail with reference to the accompanying drawings, where like reference numerals designate like elements throughout.

Figure 2:
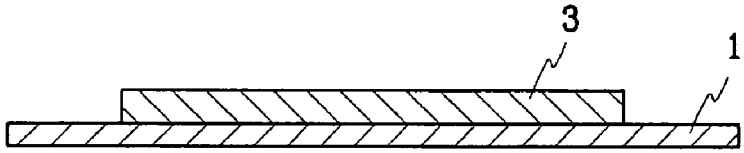

Referring to FIGS. 1–6, a manufacturing method of an embroidery patch according to the present invention will be described. The method begins with a base member 1, and placing a filler 3 on the base member 1, as shown in FIGS. 1 and 2 (Steps S10–S20 of FIG. 6). The base member 1 may be selected from a non-woven fabric, paper including cardboard, and a plastic sheet, which are adapted to be easily perforated by sewing of needles in an embroidery machine and are easily cut at the perforations. The base member 1 functions to prevent the resultant embroidery from slipping out of a desired position on the filler 3. It should be noted that the base member 1 may be omitted, although it is provided under the filler 3 in the drawings.

The filler 3 is a soft or semi-rigid sheet which has an even thickness and a size larger than a contour size of a desired embroidering figure. The filler 3 is enwrapped by a plurality of sewing threads to provide bulk. The filler is also adapted to be easily perforated by sewing of needles in an embroidery machine and to be easily cut at the perforations.

Figure 3:
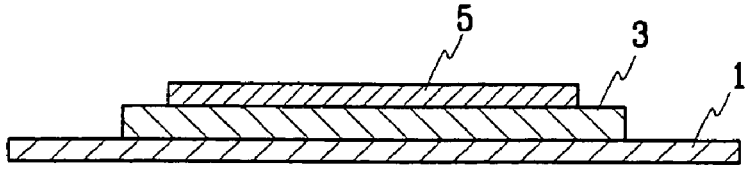
Figure 6:
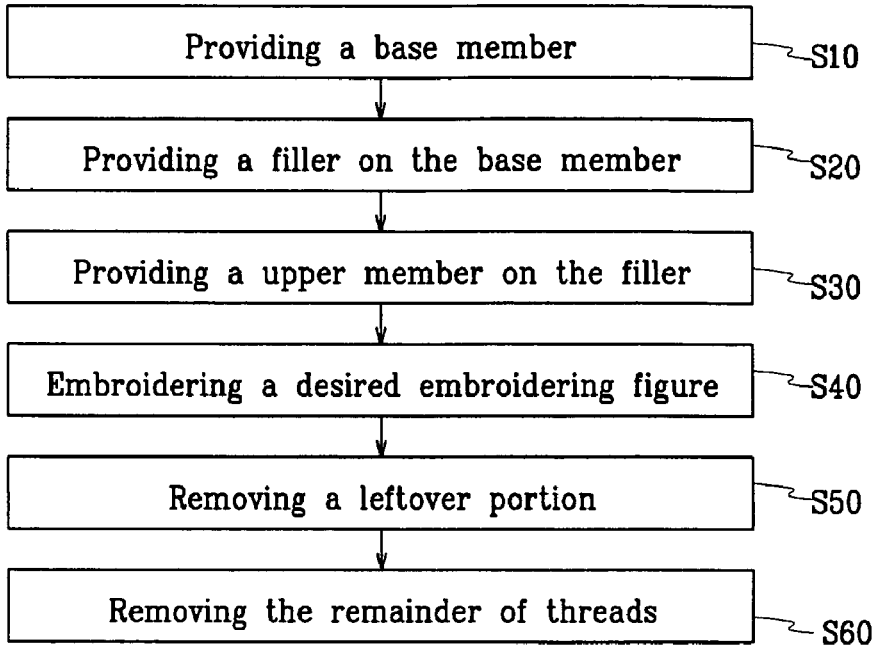
FIG. 6 is a flow chart illustrating a manufacturing method of an embroidered patch according to the present invention.

Next, an upper member 5 is provided on the filler 3 as shown in FIG. 3 (Step S30 of FIG. 6). The upper member 5 is adapted to prevent the resultant embroidery from slipping out of a desired position on the filler 3, and may be selected from a non-woven fabric, paper including cardboard, and a plastic sheet, which are capable of being easily perforated by sewing of needles in an embroidery machine and are easily cut at the perforations. Similar to the base member 1, the upper member 5 may be omitted.

Figure 4:
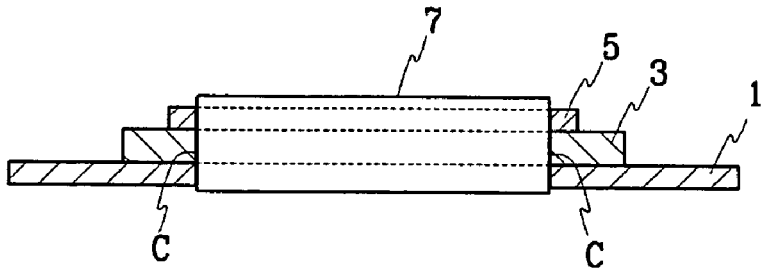
Figure 5:
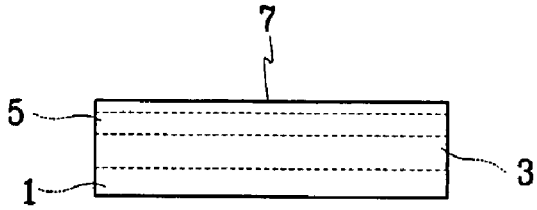

Then, the desired embroidering figure is embroidered on the base member 1, the filler 3, and the upper member 5 to entirely wrap an embroidering portion thereof by a general embroidering machine as shown in FIG. 4 (Step S40 of FIG. 6). During embroidering, a periphery of the embroidering portion is perforated by the needles of the embroidering machine and a plurality of sewing threads, so perforations C of FIG. 4 are formed. The embroidering portion is then pulled to remove a leftover portion, resulting in the embroidered patch as shown in FIG. 5 (Step S50 of FIG. 6). Next, an additional step in which remainders of threads are removed may be performed to perfect the embroidered patch (Step S60 of FIG. 6).

The method according to the present invention has an advantage in that it does not need any separate cutting process in which a cutter is used. The perforations which are adapted to remove the leftover portion are naturally formed during the embroidering by a plurality of sewing threads.

Therefore, the method may produce an embroidered patch in relatively simple manufacturing processes, resulting in improved productivity.

The present invention is applicable to all kinds of embroidery such as appliqué, embroidery having a pile structure, as well as general embroidery.

The embroidered patch according to the present invention is illustrated in FIG. 5. The patch has the base member 1, the filler 3 and the upper member 5. The plurality of sewing threads 7 enwrap the embroidering portion of the base member 1, the filler 3, and the upper member 5. As described above, both or either of the base member 1 and the upper member 5 may be omitted in specific applications. The base member 1 or the upper member 5 are adapted to prevent the resultant embroidery from slipping out of a desired position on the filler 3, and may be selected from a non-woven fabric, paper including cardboard, and a plastic sheet, which are capable of being easily perforated by sewing of needles in an embroidery machine and are easily cut by the perforations.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A manufacturing method of an embroidered patch, comprising:

providing a filler, the filler having a predetermined thickness and a size larger than a desired embroidering figure;

embroidering the desired embroidering figure on the filler to entirely wrap an embroidering portion of the filler, a periphery of the embroidering portion of the filler being perforated by a plurality of sewing threads;

removing a leftover portion, which is an outer portion of the filler surrounding the embroidering portion; and providing a base member under the filler before the embroidering, wherein the embroidering and the removing are performed on both the filler and the base member.

2. The manufacturing method of claim 1, wherein the filler is a soft or semi-rigid sheet.

3. The manufacturing method of claim 1, wherein the base member is selected from a non-woven fabric, paper, and a plastic sheet.

4. A manufacturing method of an embroidered patch, comprising:

providing a filler, the filler having a predetermined thickness and a size larger than a desired embroidering figure;

embroidering the desired embroidering figure on the filler to entirely wrap an embroidering portion of the filler, a periphery of the embroidering portion of the filler being perforated by a plurality of sewing threads;

removing a leftover portion, which is an outer portion of the filler surrounding the embroidering portion; and providing a upper member on the filler before the embroidering, wherein the embroidering and the removing are performed on both the filler and the upper member.

5. The manufacturing method of claim 4, wherein the upper member is selected from a non-woven fabric, paper, and a plastic sheet.

6. An embroidered patch comprising:

a filler having a predetermined thickness;

an upper member placed on the filler; and a plurality of sewing threads enwrapping an embroidering portion in which a desired embroidering figure is formed, a periphery of the embroidering portion being perforated by the plurality of sewing threads, wherein a leftover portion which is an outer portion of the filler and the upper member surrounding the embroidering portion is removed by cutting a periphery of the embroidering portion of the filler and the upper member.

7. The embroidered patch claim 6, wherein the filler is a soft or semi-rigid sheet.

8. The embroidered patch claim 6, wherein the upper member is selected from a non-woven fabric, paper, and a plastic sheet.

9. An embroidered patch, comprising:

a filler having a predetermined thickness;

a base member placed under the filler; and a plurality of sewing threads enwrapping an embroidering portion in which a desired embroidering figure is formed, a periphery of the embroidering portion being perforated by the plurality of sewing threads, wherein a leftover portion which is an outer portion of the filler and the base member surrounding the embroidering portion is removed by cutting a periphery of the embroidering portion of the filler and the base member.

10. The embroidered patch claim 9, wherein the base member is selected from a non-woven fabric, paper, and a plastic sheet.

11. A method of making an embroidered patch, comprising:

providing a filler having an embroidering portion;

providing a base member placed under the filler, the base member having an embroidering portion; and removing an outer portion of the filler and the base member surrounding the respective embroidering portions.

* * * * *